US005943024A

United States Patent [19]

Lydon

[11] Patent Number: 5,943,024

[45] Date of Patent: Aug. 24, 1999

[54] FEED ASSEMBLY WAVEGUIDE INTERFACE

[76] Inventor: John Lydon, 230, Carlisle, Mass. 01741

[21] Appl. No.: 09/030,622

[22] Filed: Feb. 27, 1998

[51] Int. Cl.[6] ..... H01Q 19/14

[52] U.S. Cl. ..... 343/781 R; 343/702; 343/890; 343/891; 343/892; 343/772; 333/257

[58] Field of Search ..... 343/702, 890, 343/891, 892, 840, 781 R, 772; 333/254–257, 248

[56] References Cited

U.S. PATENT DOCUMENTS 3,886,549 5/1975 Cheal et al. ..... 343/781 R
5,864,321 1/1999 Paul et al. ..... 343/702

*Primary Examiner*—Don Wong
*Assistant Examiner*—Huanb Nguyen
*Attorney, Agent, or Firm*—Michael I. Kroll

[57] ABSTRACT

A feed assembly waveguide interface (10) between an antenna (12) coupled onto an upright post (14) and an outdoor radio (16), comprising a feed tube (18) connected at a first end (20) to a sub-reflector (22) and a second end (24) having a waveguide output (26). A structure (28) is for affixing the feed tube (18) internally within the antenna (12), so that the second end (24) will extend outwardly from a rear wall (30) of the antenna (12). An assembly (32) for spring loading the feed tube (18) on the affixing structure (28) will allow the second end (24) to be forced outwardly away from the rear wall (30) of the antenna (12). When the outdoor radio (16) is mounted to the rear wall (30) of the antenna (12), a positive interface connection will be made between the outdoor radio (16) and the antenna (12), thus making a solid mechanical connection between the outdoor radio (16) and the antenna (12), as well as a proper electrical and environmental seal.

19 Claims, 7 Drawing Sheets

FEED ASSEMBLY WAVEGUIDE INTERFACE

BACKGROUND OF THE INVENTION

1. Field of the Invention

The instant invention relates generally to telecommunication equipment and more specifically it relates to a feed assembly waveguide interface. The feed assembly is spring loaded, so that when the outdoor radio is mounted onto the back of the antenna the feed assembly will make a solid mechanical connection, as well as a proper electrical and environmental seal therebetween.

2. Description of the Prior Art

Numerous telecommunication equipment have been provided in prior art that are adapted to be utilized for supplying various components for low frequency communication applications. While these units may be suitable for the particular purpose to which they address, they would not be as suitable for the purposes of the present invention as heretofore described.

SUMMARY OF THE INVENTION

A primary object of the present invention is to provide a feed assembly waveguide interface that will overcome the shortcomings of the prior art devices.

Another object is to provide a feed assembly waveguide interface that will directly attach an outdoor radio directly to an antenna, without using cables and other forms of waveguide connections.

An additional object is to provide a feed assembly waveguide interface that is spring loaded, so that when the outdoor radio is mounted onto the back of the antenna, the feed assembly will be pushed into a focal point of a reflective surface within the antenna, thus making a solid mechanical connection between the outdoor radio and the antenna, as well as a proper electrical and environmental seal.

A further object is to provide a feed assembly waveguide interface that is simple and easy to use.

A still further object is to provide a feed assembly waveguide interface that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Figure 6A:
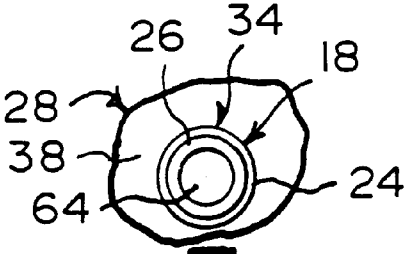
FIG. 6 is a cross sectional view, with parts broken away of a second embodiment of the instant invention per se.
Figure 6B:
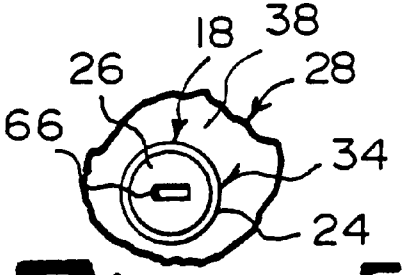
Figure 6:
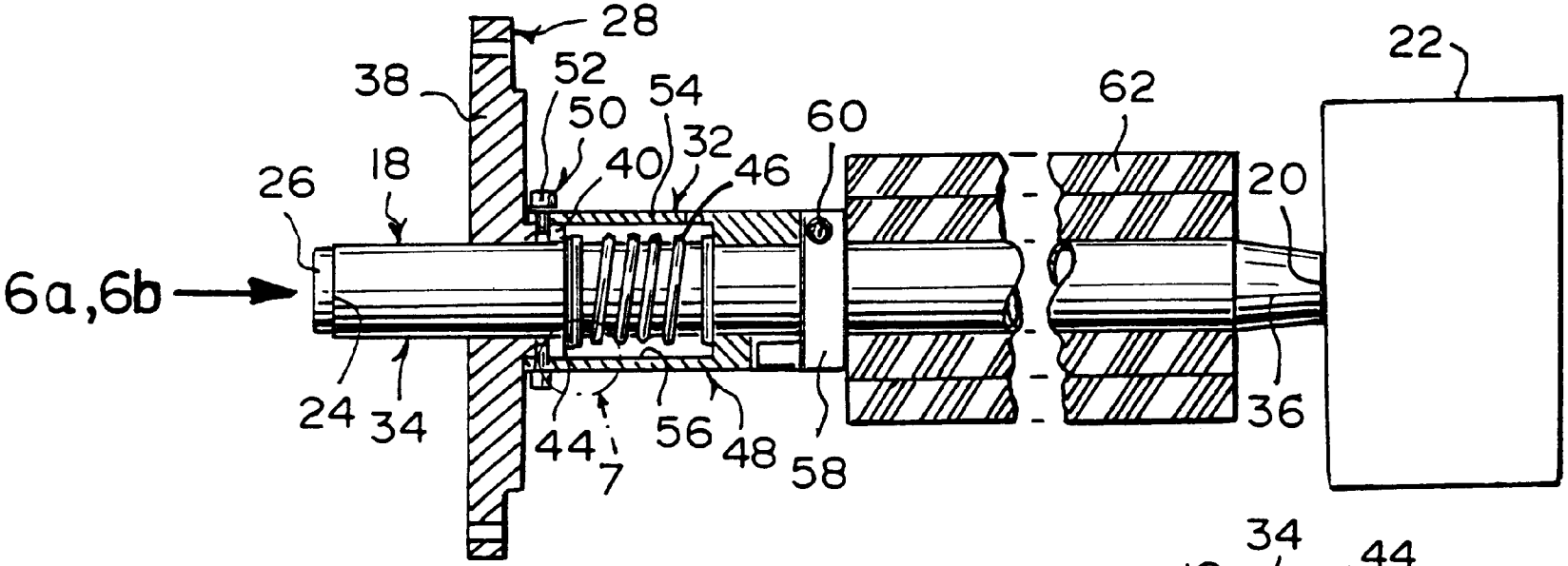

FIG. 6*a* is an end view taken in the direction of arrow 6*a* in FIG. 6, with the flange broken away showing a circular waveguide output.

FIG. 6*b* is an end view taken in the direction of arrow 6*b* in FIG. 6, with the flange broken away, showing a rectangular waveguide output.

Figure 7:
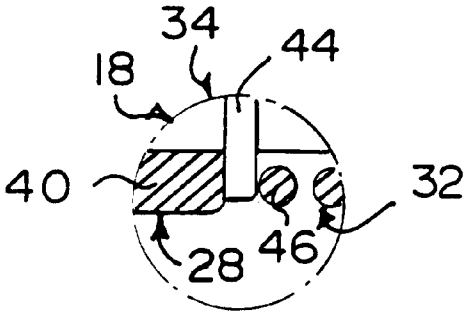

FIG. 7 is an enlarged detailed view indicated by arrow 7 in FIG. 6.

Figure 8:
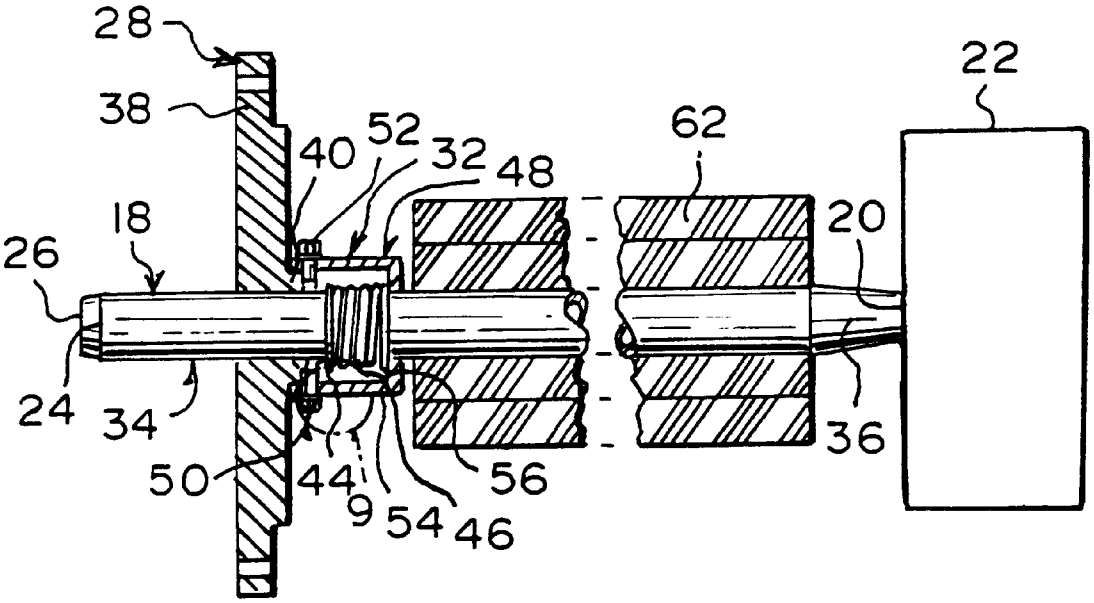

FIG. 8 is a cross sectional view, with parts broken away of a third embodiment of the instant invention per se.

Figure 9:
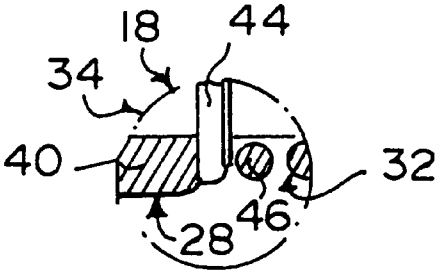

FIG. 9 is an enlarged detailed view indicated by arrow 9 in FIG. 8.

Similar reference characters denote corresponding features consistently throughout the attached drawings.

DETAILED DESCRIPTION OF THE PREFERRED EMBODIMENTS

Turning now descriptively to the drawings, in which similar reference characters denote similar elements throughout the several views, FIGS. 1 to 9 illustrate a feed assembly waveguide interface 10 between an antenna 12 coupled onto an upright post 14 and an outdoor radio 16, comprising a feed tube 18 connected at a first end 20 to a sub-reflector 22 and a second end 24 having a waveguide output 26. A structure 28 is for affixing the feed tube 18 internally within the antenna 12, so that the second end 24 will extend outwardly from a rear wall 30 of the antenna 12.

An assembly 32 for spring loading the feed tube 18 on the affixing structure 28 will allow the second end 24 to be forced outwardly away from the rear wall 30 of the antenna 12. When the outdoor radio 16 is mounted to the rear wall 30 of the antenna 12, a positive interface connection will be made between the outdoor radio 16 and the antenna 12, thus making a solid mechanical connection between the outdoor radio 16 and the antenna 12, as well as a proper electrical and environment al seal.

The feed tube 18 is an elongate hollow cylindrical member 34, having a tapered portion 36 at the first end 20. The affixing structure 20 is a flange 38 having a central sleeve 40 to allow the feed tube 18 to slide within the central sleeve 40. The flange 38 can be attached to the rear wall 30 of the antenna 12 with fasteners 42.

The spring loading assembly 32 includes a retaining ring 44 mounted on the feed tube 18 adjacent the central sleeve 40 of the flange 38. A compression spring 46 is on the feed tube adjacent the retaining ring 44. A spring housing 48 fits over the central sleeve 40 of the flange 38 and covers the retaining ring 44 and the compression spring 46. A plurality of fasteners 50 are used to retain the spring housing 48 to the central sleeve 40 of the flange 38. The compression spring 46 will always force the retaining ring 44 on the feed tube 18 against the central sleeve 40 of the flange 38.

Each fastener 50 is a setscrew 52 that threads through the spring housing 48 and into the central sleeve 40 of the flange 38. The spring housing 48 is a cylindrical casing 54 having a chamber 56 therein, for the retaining ring 44 and the compression spring 46.

Figure 1:
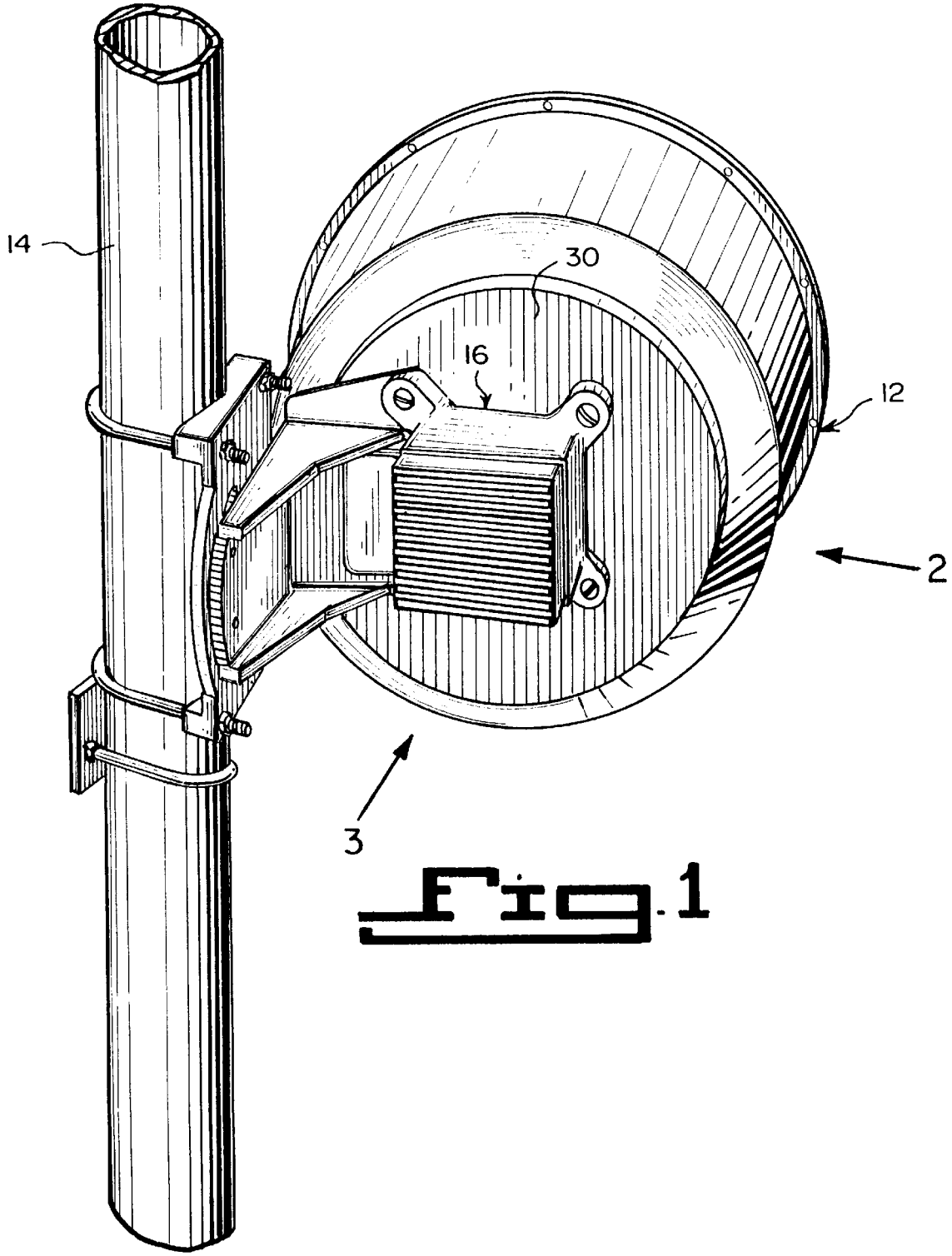
FIG. 1 is a rear perspective view showing an outdoor radio directly connected to an antenna.
Figure 2:
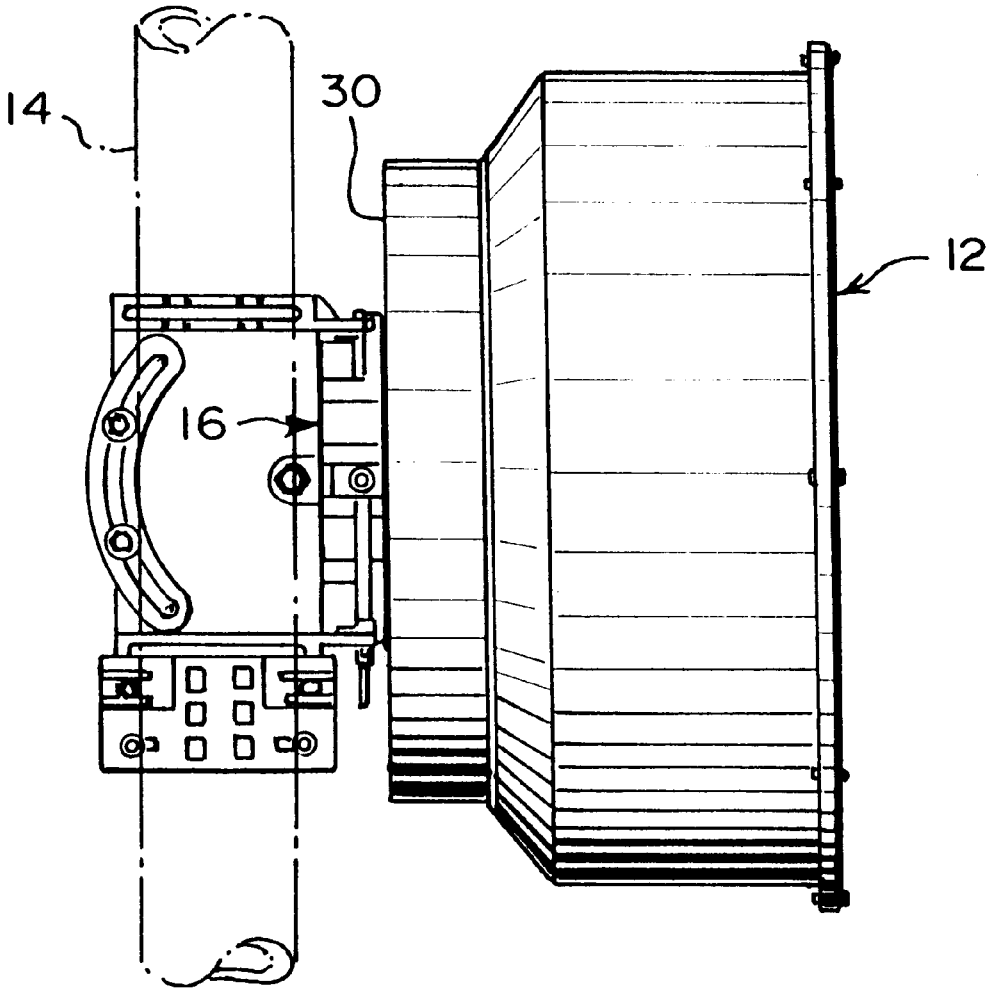
FIG. 2 is a side view taken in the direction of arrow 2 in FIG. 1.
Figure 3:
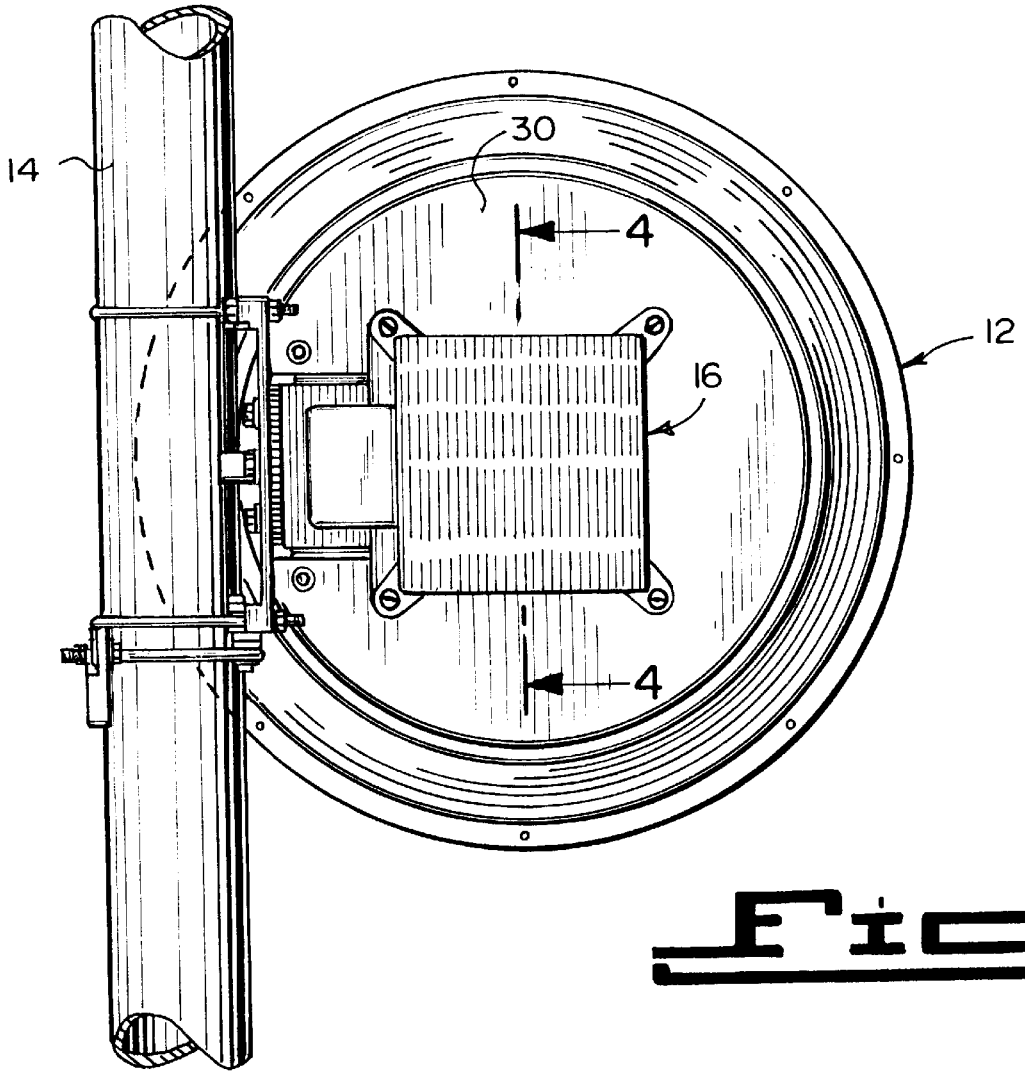
FIG. 3 is a rear view taken in the direction of arrow 3 in FIG. 1.
Figure 4:
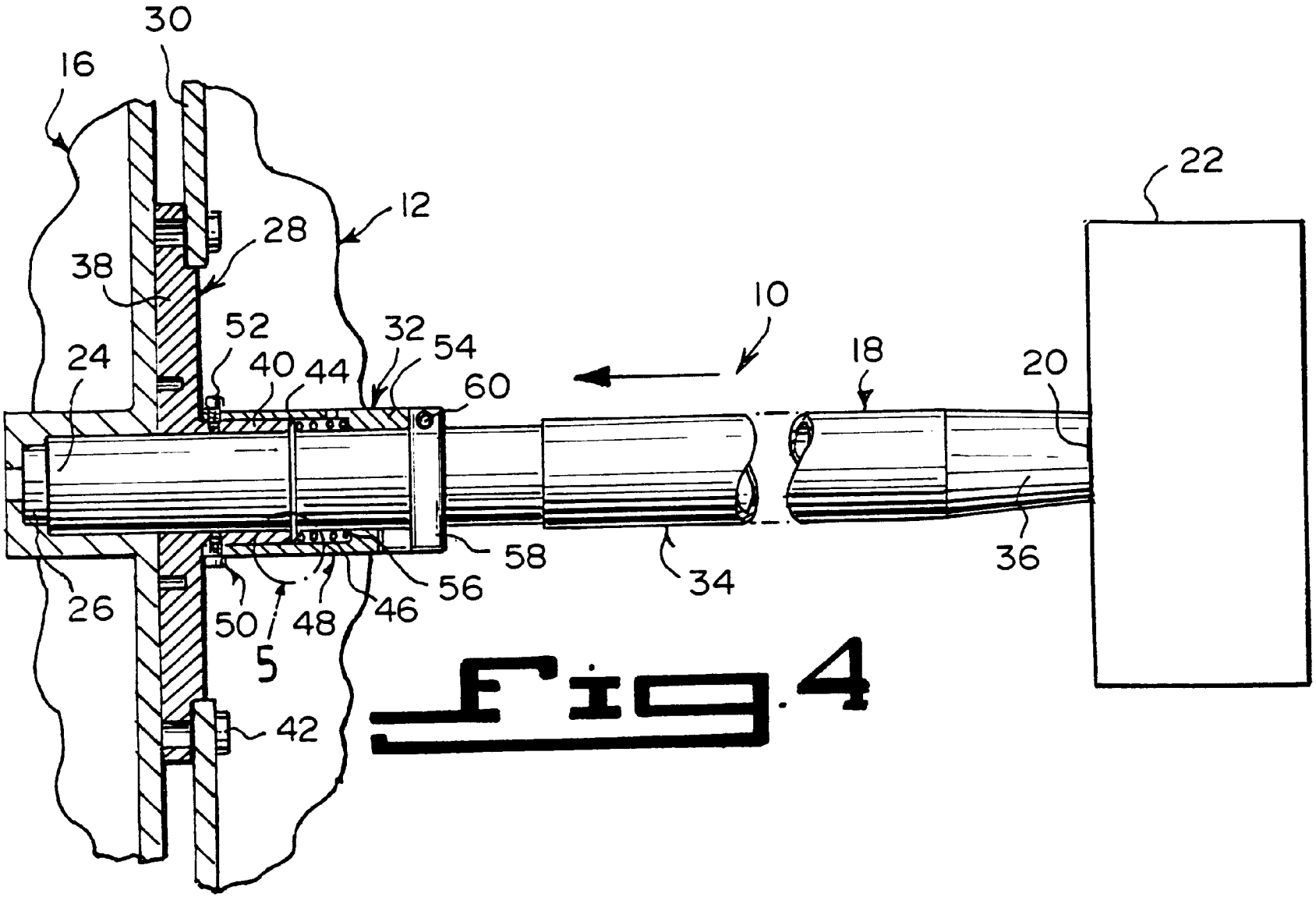
FIG. 4 is a cross sectional view taken along line 4—4 in FIG. 3, with parts broken away showing a first embodiment of the instant invention installed therein.
Figure 5:
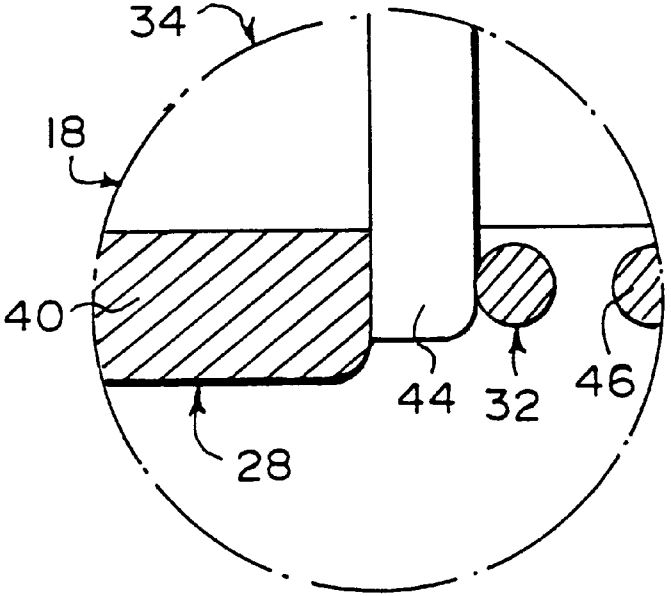
FIG. 5 is an enlarged detailed view indicated by arrow 5 in FIG. 4.

As shown in FIGS. 4 and 6, a collar 58 fits about the feed tube 18 and up against the spring housing 48. A setscrew 60 in the collar 58 retains the collar 58 against the spring housing 48. An absorber member 62 in FIG. 6 and 8, is mounted on the feed tube 18 between the spring housing 48 and the sub-reflector 22.

The waveguide output 26 on the second end 24 of the feed tube 18 can be a circular type connector 64, as best shown in FIG. 6*a*. The waveguide output 26 on the second end 24 of the feed tube 18, can also be a rectangular type connector 66, as best shown in FIG. 6*b*.

OPERATION OF THE INVENTION

To use the feed assembly waveguide interface 10, the following steps should be taken:

1. place the flange 38 against the rear wall 30 of the antenna 12.
2. Make sure that the sub-reflector 22 is extending properly within the antenna 12.
3. Secure the fasteners 42 through the rear wall 30 of the antenna 12 and into the flange 38.
4. Attach the outdoor radio 16 against the rear wall 30 of the antenna 12, so that contact is made by the compression spring 46 forcing the waveguide output 26 into the interface within the outdoor radio 16.

LIST OF REFERENCE NUMBERS

10 feed assembly waveguide interface
12 antenna on 14
14 upright post
16 outdoor radio
18 feed tube of 10
20 first end of 18
22 sub-reflector on 20
24 second end of 18
26 waveguide output on 24
28 affixing structure of 10
30 rear wall of 12
32 spring loading assembly of 10
34 elongate hollow cylinder member for 18
36 tapered portion of 34 at 20
38 flange of 28
40 central sleeve on 38
42 fastener
44 retaining ring of 32
46 compression spring of 32
48 spring housing of 32
50 fastener of 32
52 setscrew for 50
54 cylindrical casing for 48
56 chamber in 54
58 collar on 18
60 setscrew in 58
62 absorber member on 18
64 circular type connector for 26
66 rectangular type connector for 26

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A feed assembly waveguide interface between an antenna coupled onto an upright post and an outdoor radio comprising:

a) a feed tube connected at a first end to a sub-reflector and a second end having a waveguide output;

b) means for affixing said feed tube internally within the antenna, so that said second end will extend outwardly from a rear wall of the antenna; and c) means for spring loading said feed tube on said affixing means, allowing said second end to be forced outwardly away from the rear wall of the antenna, so that when the outdoor radio is mounted to the rear wall of the antenna a positive interface connection will be made between the outdoor radio and the antenna, thus making a solid mechanical connection between the outdoor radio and the antenna, as well as a proper electrical and environmental seal.

2. A feed assembly waveguide interface as recited in claim 1, wherein said feed tube is an elongate hollow cylindrical member, having a tapered portion at said first end.

3. A feed assembly waveguide interface as recited in claim 1, wherein said affixing means is a flange having a central sleeve to allow said feed tube to slide within said central sleeve, whereby said flange can be attached to the rear wall of the antenna with fasteners.

4. A feed assembly waveguide interface as recited in claim 3, wherein said spring loading means includes:

a) a retaining ring mounted on said feed tube adjacent said central sleeve of said flange;

b) a compression spring on said feed tube adjacent said retaining ring;

c) a spring housing to fit over said central sleeve of said flange and cover said retaining ring and said compression spring; and d) a plurality of fasteners to retain said spring housing to said central sleeve of said flange, so that said compression spring will always force said retaining ring on said feed tube against said central sleeve of said flange.

5. A feed assembly waveguide interface as recited in claim 4, wherein each said fastener is a setscrew that threads through said spring housing and into said central sleeve of said flange.

6. A feed assembly waveguide interface as recited in claim 4, wherein said spring housing is a cylindrical casing having a chamber therein for said retaining ring and said compression spring.

7. A feed assembly waveguide interface as recited in claim 4, further including:

a) a collar to fit about said feed tube and up against said spring housing; and b) a setscrew in said collar to retain said collar against said spring housing.

8. A feed assembly waveguide interface as recited in claim 4, further including an absorber member mounted on said feed tube between said spring housing and the sub-reflector.

9. A feed assembly waveguide interface as recited in claim 1, wherein said waveguide output on said second end of said feed tube is a circular type connector.

10. A feed assembly waveguide interface as recited in claim 1, wherein said waveguide output on said second end of said feed tube is a rectangular type connector.

11. A feed assembly waveguide interface between an antenna coupled onto an upright post and an outdoor radio comprising:

a) a feed tube connected at a first end to a sub-reflector and a second end having a waveguide output, wherein said feed tube is an elongate hollow cylindrical member, having a tapered portion at said first end;

b) means for affixing said feed tube internally within the antenna, so that said second end will extend outwardly from a rear wall of the antenna; and c) means for spring loading said feed tube on said affixing means, allowing said second end to be forced outwardly away from the rear wall of the antenna, so that when the outdoor radio is mounted to the rear wall of the antenna a positive interface connection will be made between the outdoor radio and the antenna, thus making a solid mechanical connection between the outdoor radio and the antenna, as well as a proper electrical and environmental seal.

12. A feed assembly waveguide interface as recited in claim 11, wherein said affixing means is a flange having a central sleeve to allow said feed tube to slide within said central sleeve, whereby said flange can be attached to the rear wall of the antenna with fasteners.

13. A feed assembly waveguide interface as recited in claim 12, wherein said spring loading means includes:

a) a retaining ring mounted on said feed tube adjacent said central sleeve of said flange;

b) a compression spring on said feed tube adjacent said retaining ring;

c) a spring housing to fit over said central sleeve of said flange and cover said retaining ring and said compression spring; and d) a plurality of fasteners to retain said spring housing to said central sleeve of said flange, so that said compression spring will always force said retaining ring on said feed tube against said central sleeve of said flange.

14. A feed assembly waveguide interface as recited in claim 13, wherein each said fastener is a setscrew that threads through said spring housing and into said central sleeve of said flange.

15. A feed assembly waveguide interface as recited in claim 14, wherein said spring housing is a cylindrical casing having a chamber therein for said retaining ring and said compression spring.

16. A feed assembly waveguide interface as recited in claim 15, further including:

a) a collar to fit about said feed tube and up against said spring housing; and b) a setscrew in said collar to retain said collar against said spring housing.

17. A feed assembly waveguide interface as recited in claim 16, further including an absorber member mounted on said feed tube between said spring housing and the sub-reflector.

18. A feed assembly waveguide interface as recited in claim 17, wherein said waveguide output on said second end of said feed tube is a circular type connector.

19. A feed assembly waveguide interface as recited in claim 17, wherein said waveguide output on said second end of said feed tube is a rectangular type connector.

* * * * *